United States Patent [19]

Boegle

[11] Patent Number: 4,783,946

[45] Date of Patent: Nov. 15, 1988

[54] SUPPORTING RAIL FOR LOWER CEILINGS AND ATTACHMENTS

[76] Inventor: Normann Boegle, Melanchthonstrasse 22, D-7410 Reutlingen, Fed. Rep. of Germany

[21] Appl. No.: 906,912

[22] Filed: Sep. 11, 1986

[30] Foreign Application Priority Data

Feb. 26, 1986 [DE] Fed. Rep. of Germany ..... 3606112

[51] Int. Cl.[4] ..... E04C 3/30

[52] U.S. Cl. ..... 52/720; 52/484; 52/669

[58] Field of Search ..... 52/74, 75, 76, 77, 78, 52/488, 484, 714, 720, 669, 762, 85, 739, 773, 222

[56] References Cited

U.S. PATENT DOCUMENTS

| | | | |
|---|---|---|---|
| 3,016,585 | 1/1962 | Chial | 52/78 X |
| 3,078,971 | 2/1963 | Wallerstein, Jr. | 52/720 X |
| 3,159,251 | 12/1964 | Becker | 52/484 X |
| 3,369,332 | 2/1968 | Harlan | 52/720 X |
| 3,413,774 | 12/1968 | Oberreich | 52/720 |
| 4,270,327 | 6/1981 | Van Leeuwen | 52/720 X |
| 4,545,165 | 10/1985 | Carey et al. | 52/488 |
| 4,580,382 | 4/1986 | Judkins et al. | 52/669 X |
| 4,660,348 | 4/1987 | LaLonde | 52/484 X |

*Primary Examiner*—David A. Scherbel
*Assistant Examiner*—Creighton Smith
*Attorney, Agent, or Firm*—Michael J. Striker

[57] ABSTRACT

A supporting rail for objects, particularly, lower ceilings, attachments and the like, comprises an elongated central rail part, and at least one elongated side rail edge extending along the central rail part and located at its one end for suspending shaped panels, boards and the like, the central rail part being provided for supporting curved objects with a plurality of formations spaced from one another in a longitudinal direction and allowing bending said central rail part, the central rail part being also provided with a plurality of through-going openings located between the formations for inserting additional elements.

26 Claims, 8 Drawing Sheets

Fig. 2
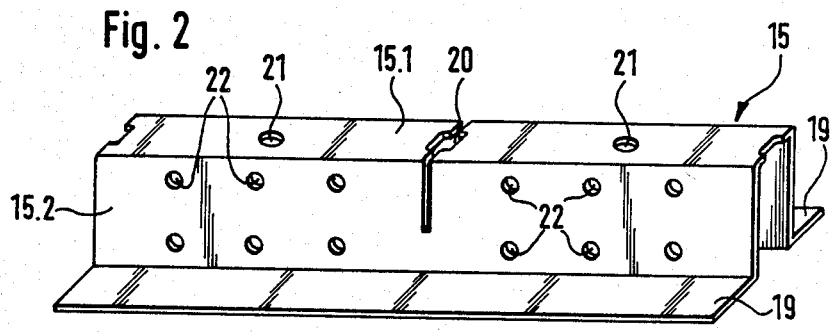
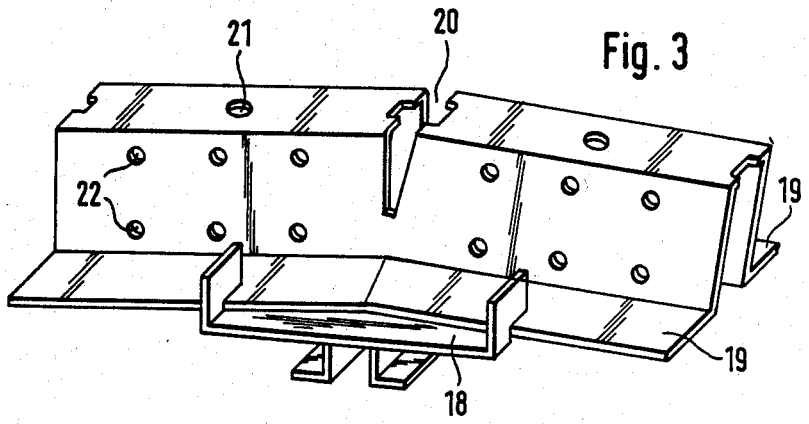
Fig. 3

Fig. 4
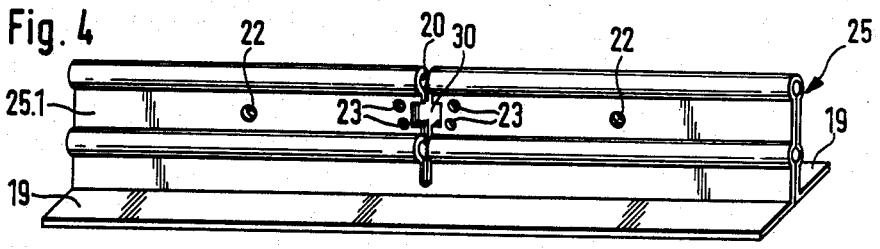
Fig. 5
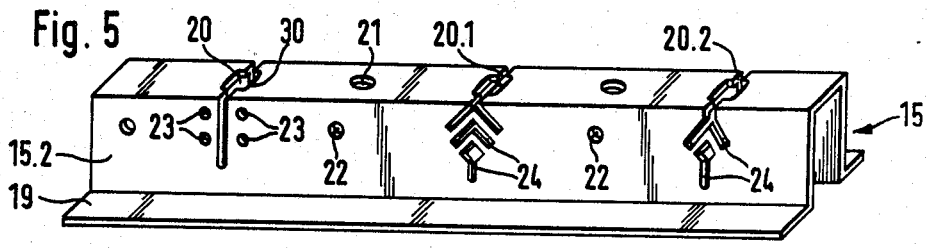
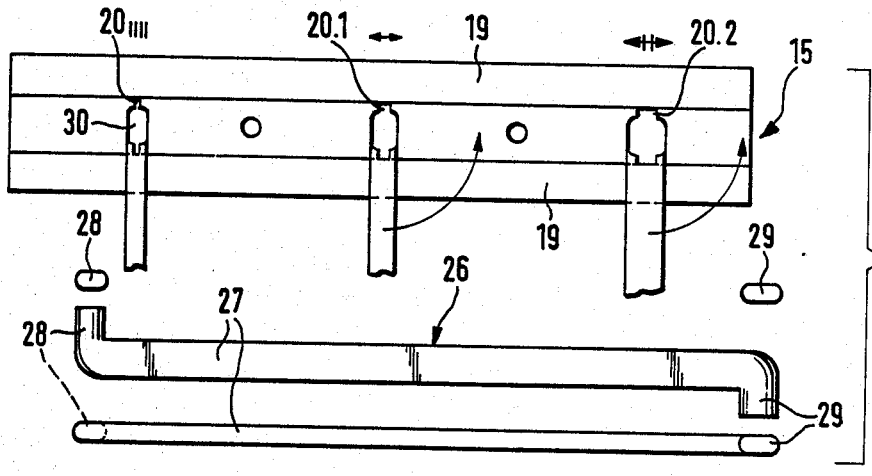
Fig. 6
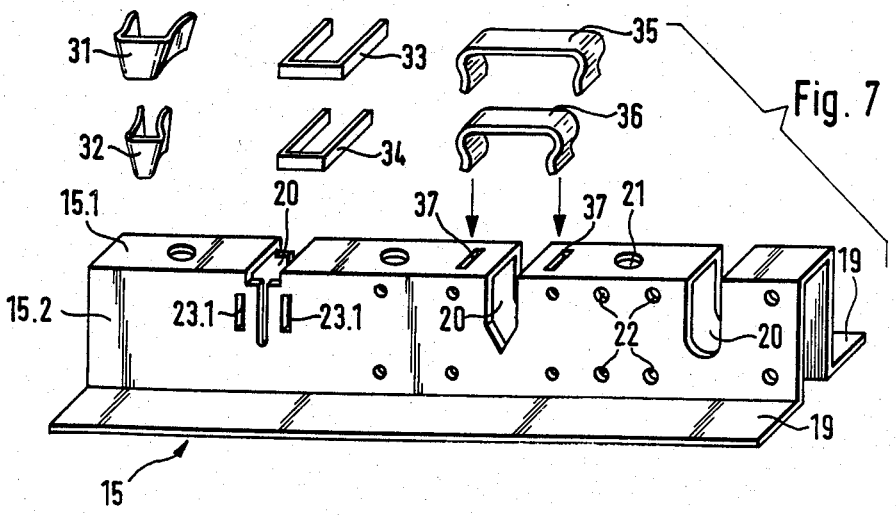
Fig. 7

SUPPORTING RAIL FOR LOWER CEILINGS AND ATTACHMENTS

BACKGROUND OF THE INVENTION

The present invention relates to a supporting rail for lower ceilings, attachments and the like. More particularly, it relates to a supporting rail which has a rail central part with outwardly projecting rail edges for mounting clips which hold shaped panels or plates on the supporting rail.

Supporting rails of the above mentioned general type are known in the art and used in suspended constructions for lower ceilings to be suspended on a building ceiling. In the known suspending constructions only rectilinearly extending supporting rails are used. It is to be understood that this severely limits the use of such supporting rails.

SUMMARY OF THE INVENTION

Accordingly, it is an object of the present invention to provide a supporting rail which can be suitable for producing curved lower ceilings, attachments and the like.

In keeping with these objects and with others which will become apparent hereinafter, one feature of the present invention resides, briefly stated, in a supporting rail which has a central rail part and at least one side rail edge, in which a plurality of formations are provided in the central rail part for allowing bending of the central rail part, and a plurality of through-going openings are provided between the formations for inserting additional elements.

The formations can be formed as cuts which not only allow bending of the central rail part but also allow insertion of a spreading tool for spreading the central rail part to provide a curved configuration. The formations can also be formed as corrugations which allow compression of the central rail part in a longitudinal direction. The elements insertable into through-going openings can be coupling elements, securing elements or suspending elements.

Supporting rails of the above type are produced from a thin metal sheet and obtain their stability by its profiling and formation a U-shaped rail or a T-shaped rail. The small wall thickness of the supporting rails does not allow bending of the rails in rolling process, for example as performed with metal pipes having greater wall thickness. Instead, for avoiding their cracking, the rails are provided for bending with cuts in expansion zones and/or with corrugations in compression zones for the rail shortening. By the exact selection of dimensions of the cuts and/or the corrugations, the use of the spreading tool or the use of the bending rollers can provide for a predetermined bending radii. The through-going openings in the supporting rail provide for a possibility of arranging securing rails other securing elements for maintaining under load the predetermined bending and preventing further deformation or return deformation.

The supporting rail formed in accordance with the present invention has the advantage that an individual desired curvature can be obtained in situ. The supporting rails can also be pre-fabricated to have a desired curvature and for example assembled of individual shorter and precurved portions or individually curvable portions. Each portion can be provided in the central rail part with a plug projection at its end, which is insertable into a respective plug opening at the end of the central rail part of the neighboring portion. The through-going openings are aligned with one another in the connecting region so as to allow insertion of coupling elements, in particular coupling pins.

The cuts which are formed in the supporting rails can each be composed of a plurality of individual cut portions which after spreading by means of a spreading tool, form a metal mesh-like deformation of the respective wall regions. By this deformation, simultaneously securing of the spreading position of the supporting rail is achieved. In the U-shaped supporting rails, an inclined position of the cuts in a base of the U-shaped profile guarantees that the supporting rail can pass through a bending roller device without excessive spreading of the rollers at the cut regions of the rail.

The self-bending of the supporting rails by a house worker can be facilitated by a special spreading tool which in accordance with the present invention has a tool shaft and at least one spreading end insertable into the cuts and having a predetermined width and/or predetermined angle relative to the tool shaft, to provide a desired spreading action over a predetermined spreading angle. Such a spreading tool can have the spreading ends at both sides of the tool shaft. The spreading ends can be formed with different widths and/or different angular arrangement. Also, a predetermined spreading angle can be achieved by a limiting of the engaging movement of such spreading tool by means of preferably movable or releasable abutment.

Anchoring of the curved supporting rail in accordance with the present invention on a building ceiling can be performed by means of suspending elements in a suspending construction with additional reinforcing action. In accordance with the present invention, the suspending elements can be formed as known suspending rails which, however, are provided with at least one wider coupling part at their end for abutting against the supporting rail. The coupling part can have at least one row of openings arranged along a circular arc. These suspending elements can be connected to a predetermined angular position with the supporting rail and/or other suspending elements. For example, at the coupling locations several or at least two coupling pins can be inserted into aligned openings of the suspending element and the supporting rail, to avoid pivotal coupling locations.

Securing elements or combined secured and coupling elements can be formed as U-shaped clamps with legs insertable into the openings of the supporting rail. An adjusted spreading position of a supporting rail can be secured by means of plug parts of a predetermined pitch insertable into the cuts.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a view showing a section of a U-shaped supporting rail in accordance with the present invention, in a rectilinear position;

FIG. 3 is a view showing the portion of the supporting rail of FIG. 2 after bending to a curved position;

FIG. 4 is a view showing a portion of a T-shaped supporting rail in accordance with the present invention;

FIG. 5 is a view showing a portion of the U-shaped supporting rail in accordance with the present invention with differently formed cuts;

FIG. 6 is a plan view of the portion of the supporting rail of FIG. 5, after spreading, together with a special spreading tool;

FIG. 7 is a view showing a portion of the supporting rail of the invention with cuts of different shapes and with associated through-going openings, as well as with different securing elements insertable into the supporting rails;

DESCRIPTION OF THE PREFERRED EMBODIMENTS

Figure 1:
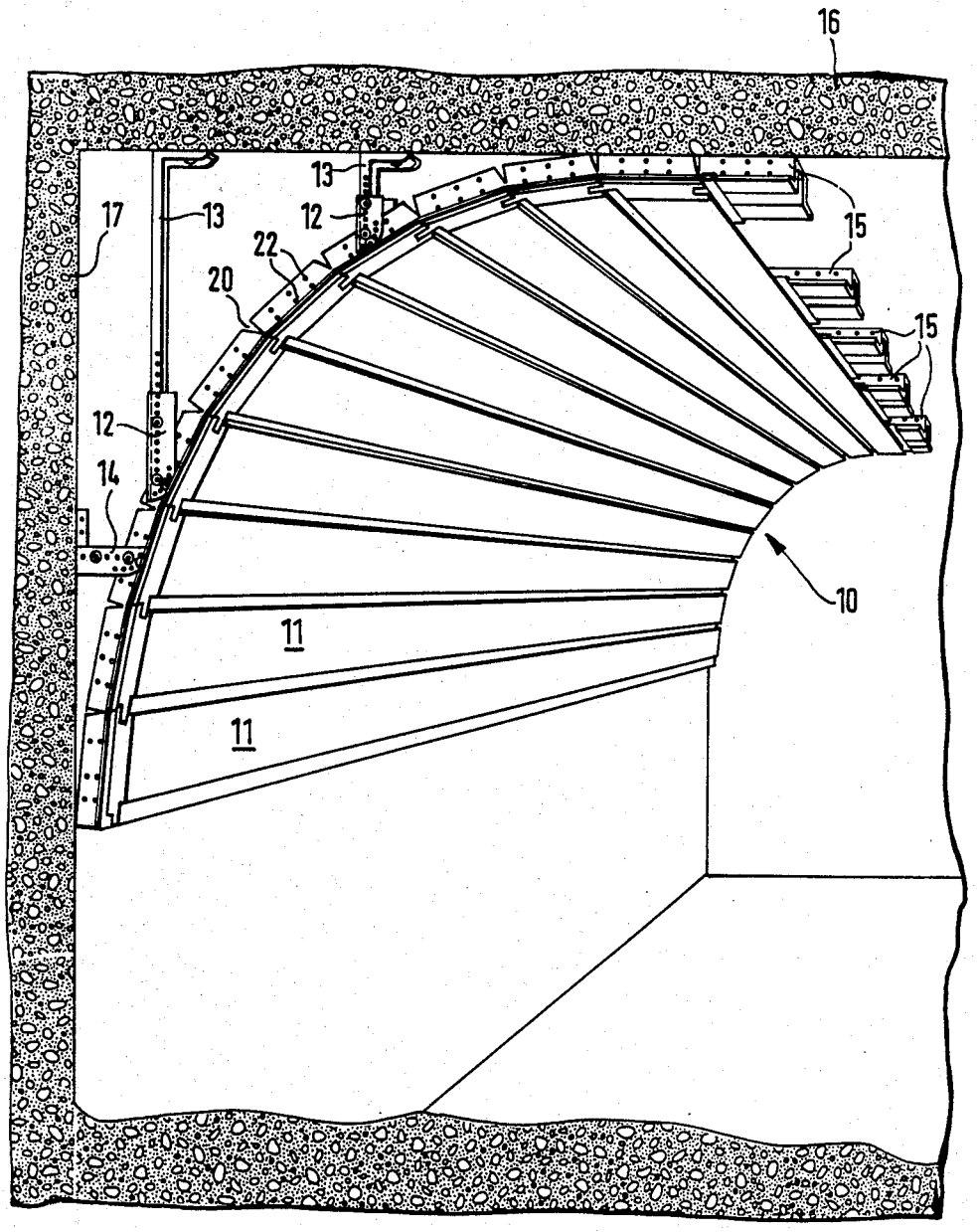
FIG. 1 is a perspective partial view of a curved lower ceiling and its supporting structure with a supporting rail in accordance with the present invention.

FIG. 1 shows a curved lower ceiling 10 which is composed of a plurality of neighboring and interengaged shaped panels 11. A supporting structure for the ceiling includes a plurality of curved supporting rails 15 which are arranged at a distance from one another and anchored in a ceiling 16 and in side walls 17 via suspending elements 12, 13 and 14. The shaped panels 11 are mounted on the supporting rails 15 by means of clips 18 which are known per se and more clearly shown in FIG. 3.

FIGS. 2–7 show different embodiments of supporting rails which are provided with outwardly projecting rail edges 19 for mounting the clips 18.

FIG. 2 shows a portion of the U-shaped supporting rail 15 shown in FIG. 1. It is provided with bending cuts 20 which extend transverse to the longitudinal direction of the rail and are spaced from one another by uniform distances. The bending cuts 20 extend through a base 15.1 and through a part of both legs 15.2 of the U-shaped supporting rail 15. By means of the bending cuts 20, the supporting rail of FIG. 3 can be spread for obtaining a curved supporting rail. Through-going openings 21 and 22 are provided in the supporting rail 15 both in the base 15.1 and the legs 15.2 between the uniformly distributed bending cuts 20.

FIG. 4 shows a supporting rail 25 which is T-shaped and bent from a metal sheet strip. A web 25.1 which forms the central part of the supporting rail 25 is made of two abutting sheet portions. The bending cuts 20 are formed here in the web 25', and the through-going openings 22 are also provided between the individual bending cuts. In the immediate vicinity to the bending cuts, further through-going openings 23 are provided for inserting safety clamps which will be described later on in connection with FIG. 7.

FIG. 5 shows a U-shaped supporting rail 15 with differently formed bending cuts 20. At the left end of the supporting rail, a small bending cut 20 is formed which is similar to the bending cuts of FIGS. 2 and 3, and through-going openings 23 are provided in both legs 15.2. In the center of the supporting rail and at its right end, bending cuts 20.1 and 20.2 are provided and subdivided in the legs 15.2 of the supporting rail 15 into individual cut sections 24. These individual cut sections 24 produced during spreading of the cuts 20.1 and 20.2 a deformation between inwardly located wall regions, similarly to the production of metal mesh, and the wall deformation which takes place adds also for stabilizing the supporting rail 15 at the spreading locations for securing the performed spreading.

For obtaining an exactly determined spreading and thereby a desired predetermined curvature of the supporting rail 15, spreading tools shown in FIGS. 6, 8, 9 and 10 are utilized. FIG. 6 shows a spreading tool 26 which includes a web-like shaft 27 with perpendicularly bent ends and these bent ends form spreading ends 28 and 29 with an exactly predetermined width measurement. The spreading end 28 is relatively small. It can be inserted in an expanded central part 30 the bending cuts 20, 20.1 or 20.2. By turning of the shaft 27 of the spreading tool 26 by 90°, spreading is performed by a spreading angle which is exactly predetermined by the width of the spreading end 28. The spreading end 29 of the spreading tool 26 is wider. With this spreading end, during turning of the introduced spreading tool 26, a greater spreading angle is obtained as shown in FIG. 6 for the bending cut 20.2.

The spreading angles adjusted on the bending cuts 20 can be secured by elements shown in FIG. 7. These elements can be formed as wedges 31 and 32 which are made of sheet portions and have corresponding wedge angles, as clamps 33 and 34, as brackets 35 and 36 of different widths or lengths. The clamps 33 and 34 can be inserted in slot-shaped through-going openings 23.1 shown in FIG. 7. These openings are formed at both sides of a bending cut in the legs 15.2 of the U-shaped supporting rail. The brackets 35 and 36 can be inserted after spreading of the bending cuts 20 into slot-shaped recesses 37 which are formed in the base 15.1 of the supporting rail 15. FIG. 7 shows further possible embodiments for the bending cuts 20.

Figure 8:
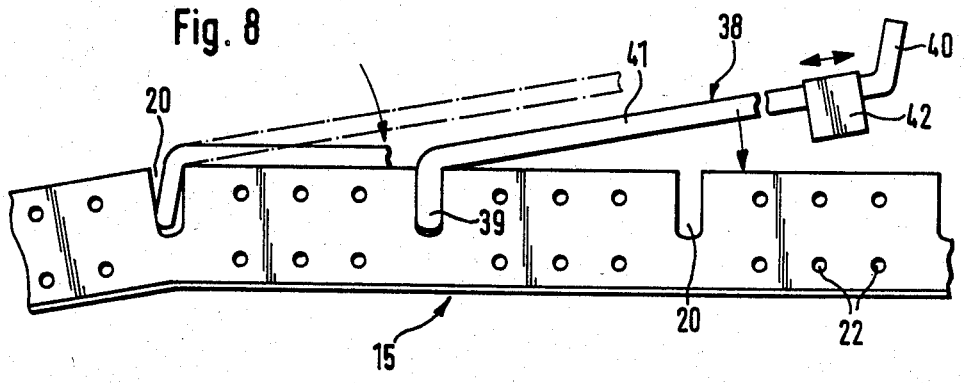
FIG. 8 is a partial side view of a supporting rail in accordance with the present invention with a spreading tool placed thereon.
Figure 9:
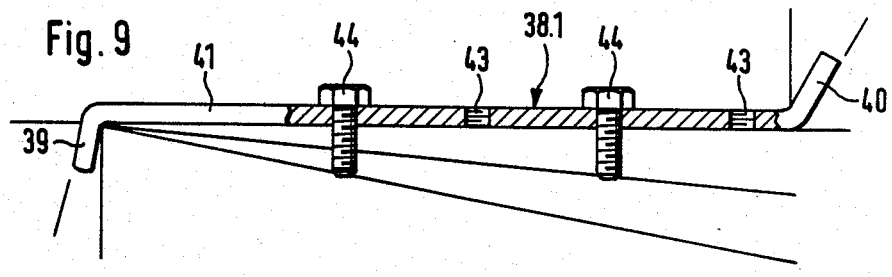
FIG. 9 is a side view of the spreading tool in accordance with another embodiment of the invention, associated with the supporting rail.

FIG. 8 shows a spreading tool 38 on the supporting rail 15. Both spreading ends 39 and 40 are arranged at different angles relative to a shaft 41 of the spreading tool 38, and upon pressing down of the shaft 41 relative to the base of the supporting rail 15 produce different spreading of the cuts 20. An abutment 42 is movably arranged on the shaft 41 and, depending upon its position of the shaft 41, more or less limits the lever path of the spreading tool 38 so as to produce different spreading angles at the locations of the bending cuts 20. Instead of the movable abutment 42, a spreading tool 38' can be provided at fixed locations of its shaft 41 with threaded openings 43 so that screw 44 can be screwed into the openings 43 to form the abutments for limiting more or less the lever path of the spreading tool 38.1. The spreading tool in accordance with this embodiment is shown in FIG. 9.

Figure 10:
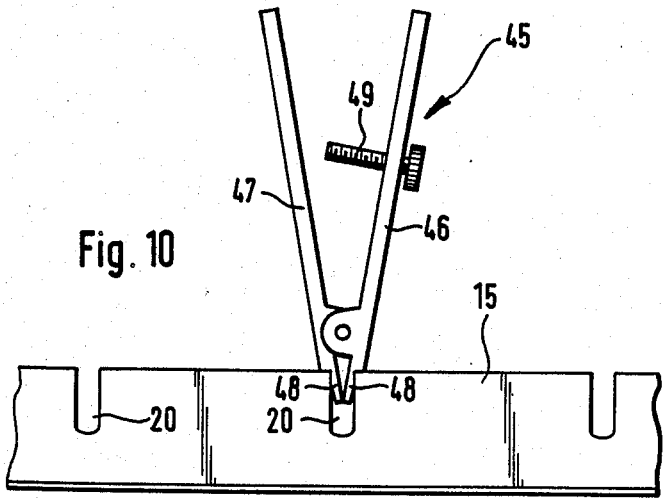
FIG. 10 is a view showing the spreading tool in accordance with still a further embodiment to be used with the supporting rail.

FIG. 10 shows a pliers-shaped spreading tool 45 with two pivotally connected levers 46 and 47. One end of the levers is formed as a spreading end 48. During opposite movement of two levers 46 and 47, spreading of the supporting 15 is performed by means of the spreading end 48 inserted in the bending slot 20. The desirable spreading angle can be adjusted by means of an adjusting screw 49.

Figure 11:
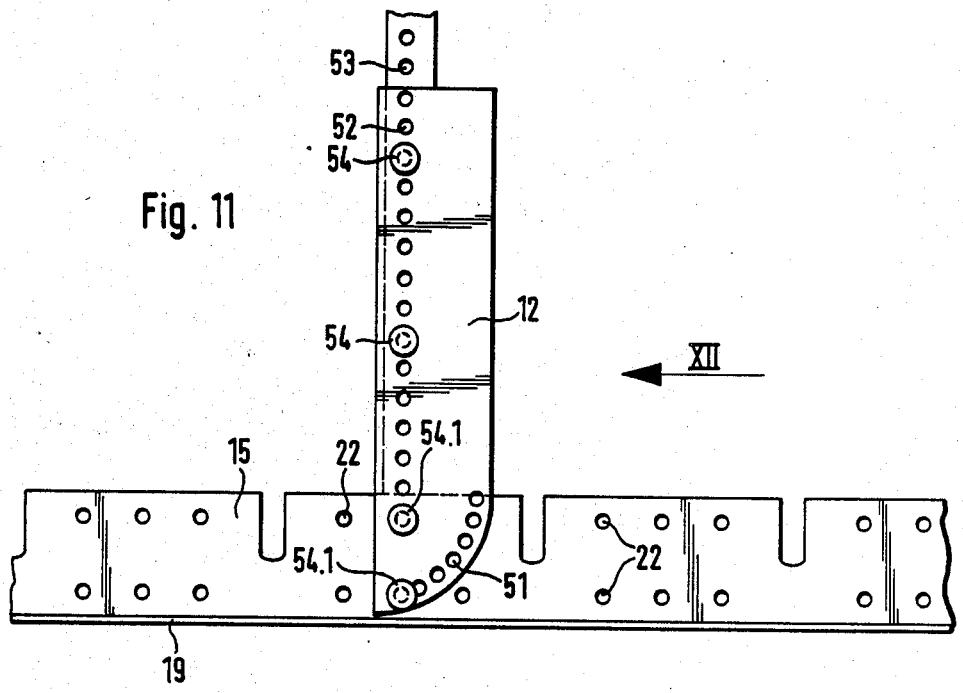
FIG. 11 is a partial view of the supporting rail of the present invention with a suspending element connected therewith.
Figure 12:
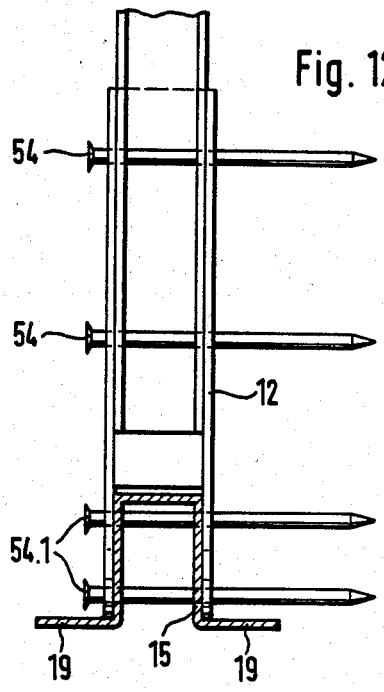
FIG. 12 is a side view of a connecting point with the suspending element in direction of the arrow XII in FIG. 11.

FIGS. 11 and 12 show a suspending element 12 which is connected with the supporting rail 15 and has a U-shaped cross section. The supporting rail 15 is coupled with a suspending rail 13 via the suspending element 12 [a hanger]. The suspending element 12 and the suspending rail 13 are provided with a row of openings 52 and 53 in their legs. They can be brought in alignment with one another and a simple needle 54 can be inserted therethrough as a connecting element. The suspending element 12 is provided additionally with a row of openings 55 which are arranged in a crossing member at least at one end of the legs. The distances from the openings of the opening row 55 from an opening of the opening row 52 are determined upon the opposite distance from the through-going openings 22 of the supporting rail 15. Mounting of the supporting rail 15 on the suspending element 12 is performed by means of two needles 54.1. One of the needles is inserted through an opening of the opening row 52 of the suspending element 12 and through a through-going opening 22, while the other needle 54.1 is inserted in an opening or arcurately extending opening row 55 and a through-going opening 22 of the supporting rail 15. By means of the coupling with the aid of two needles 54.1, a predetermined angular position of the suspending element 12 relative to the supporting rail 15 can be adjusted, as can be seen from FIG. 17.

Figure 13:
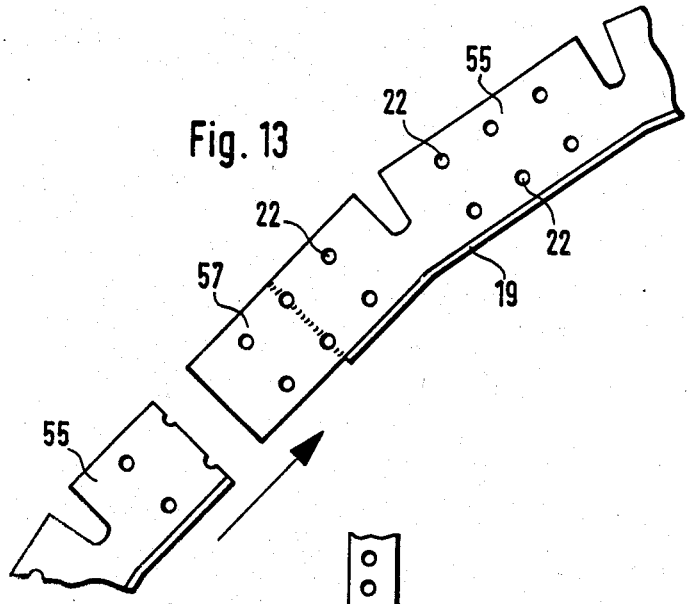
FIG. 13 a partial view of two interconnected portions a curved supporting rail in accordance with the present invention.
Figure 14:
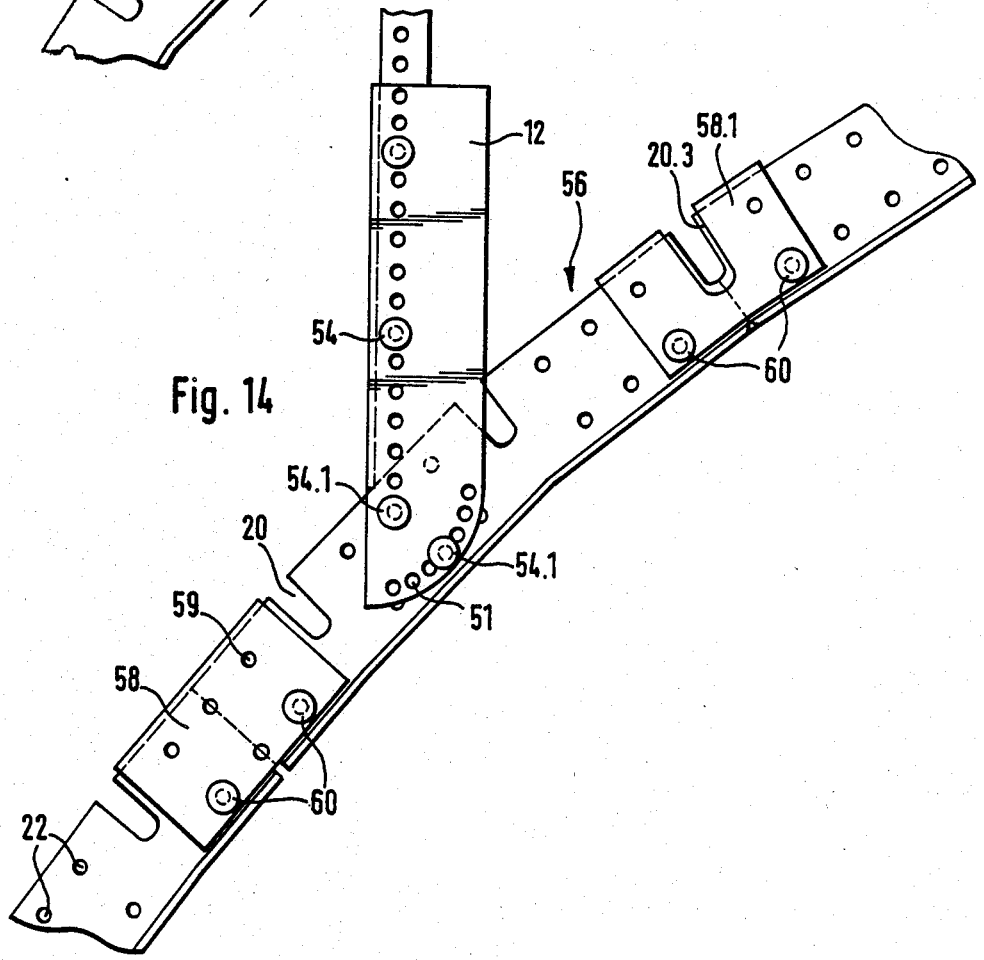
FIG. 14 is a partial side view of a curved supporting rail assembled of several portions, in accordance with the present invention, in the region of its connected point with a suspending element.

FIG. 13 shows a connecting point between two portions 55 of a supporting rail 56 which is assembled of a plurality of such curved portions 55. At one end of the portion 55 of the supporting rail, its central part is provided with a plug projection 57 which does not have laterally extending edge 19. The plug projection 57 engages in a plug opening which is formed at the other end of the portion 55. After insertion of the projection 57 into the not-shown matching plug opening of the neighboring portion 55, a U-shaped bridge member 58 is fitted onto the connecting location. The bridge member 58 is provided with through-going openings 59 which can be brought in alignment with the through-going openings 22 of the portion of the supporting rail, so that coupling pins 60 can be passed through. The bridge member 58 shown in FIG. 14 can also be provided with a cut 20.3 and arranged at the locations of the cuts 20 in the supporting rail 15 for reinforcing or bending securing of the latter. FIG. 14 also shows one suspending element 12 is connected with the supporting rail 56 in a desired angular position and secured by the coupling pin 54.1 in this position.

Figure 15:
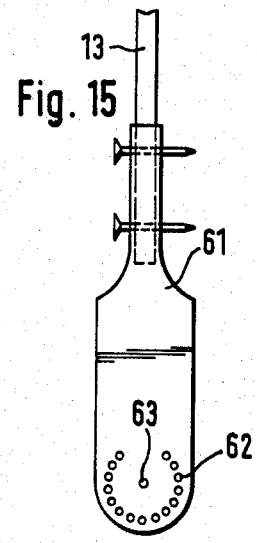
FIG. 15 is a view showing the suspending element.

FIG. 15 shows another suspending element 61 in form of a connecting plate with an end provided with a row of openings 62 which are arranged over a circle around an opening 63 provided in a central point. The other end of the suspending element 61 is U-shaped in a known manner for embracing a suspending rail 13. The circularly arranged row of openings 62 in connection with the fixation described in FIGS. 11 and 14 provides a desired or required angular position of the suspending element 61 relative to the supporting rails 15, 25 or 56.

Figure 16:
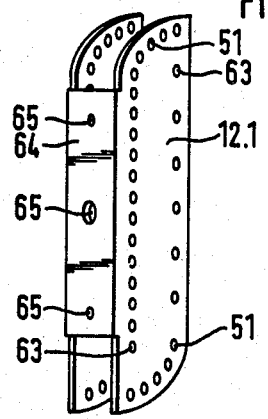
FIG. 16 is a perspective view of the suspending element of FIG. 15.

FIG. 16 shows a suspending element 12.1 which is formed similarly to the suspending element 12 of FIGS. 11 and 14. The legs of the suspending element 12.1 are rounded at one side of each end and provided at each end with the openings 55 extending over a circular arc about the associated openings 63 in the center point. Openings 65 are also provided in a base 64.

Figure 17:
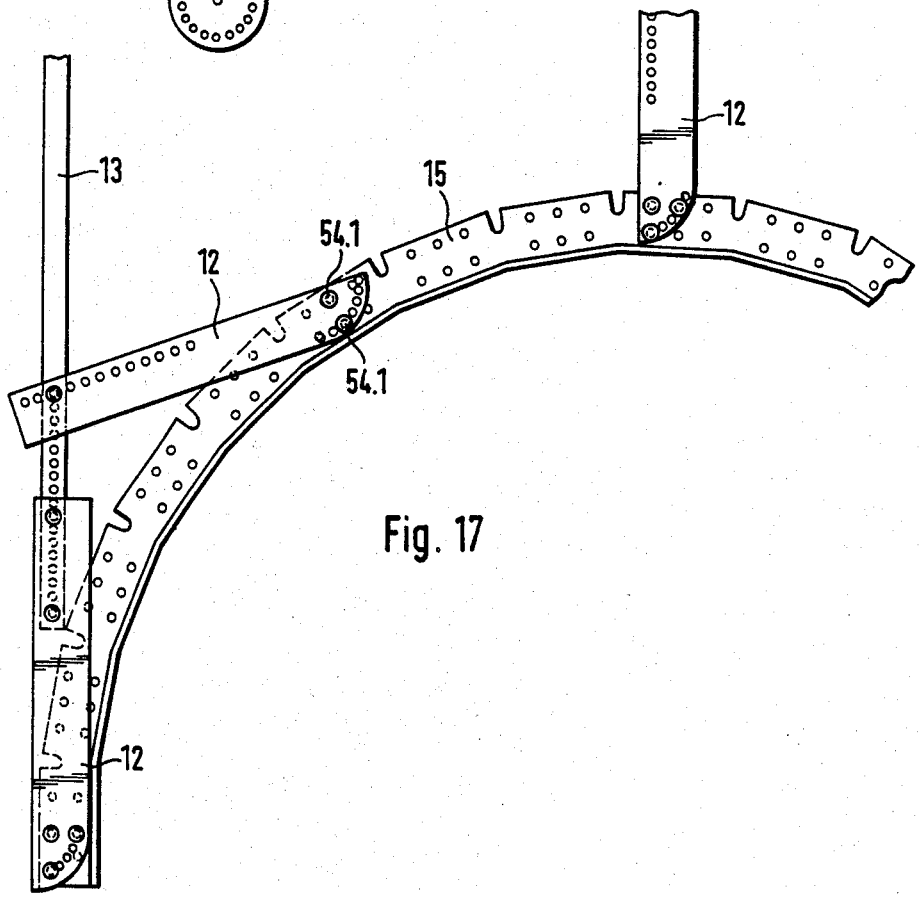
FIG. 17 is a partial view of a curved supporting rail in accordance with the present invention, together with a part of a suspending construction to hold the rail.

FIG. 17 shows a curved supporting rail 15 with suspending elements engaged thereon. One suspending element 12 is formed as a transverse reinforcing web between a suspending rail 13 and the curved supporting rail 15 and arranged in a transverse position. In this relative position it is secured to the supporting rail by means of two coupling pins 54.1. Instead of suspending elements 12 also the suspending elements 61 of FIG. 15 can be used here.

Figure 18:
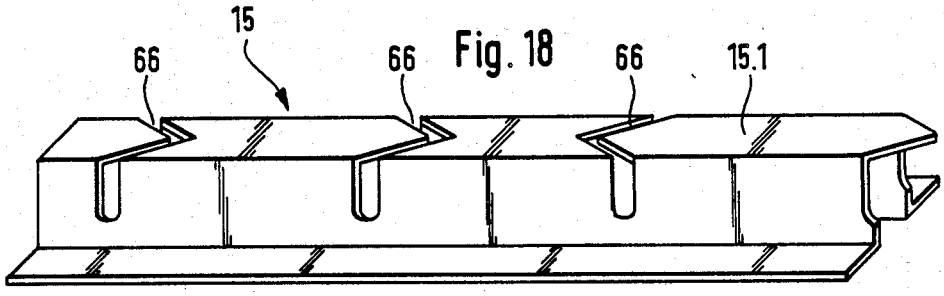
FIG. 18 is a view showing a portion of the supporting rail with arrow-shaped cuts.
Figure 19:
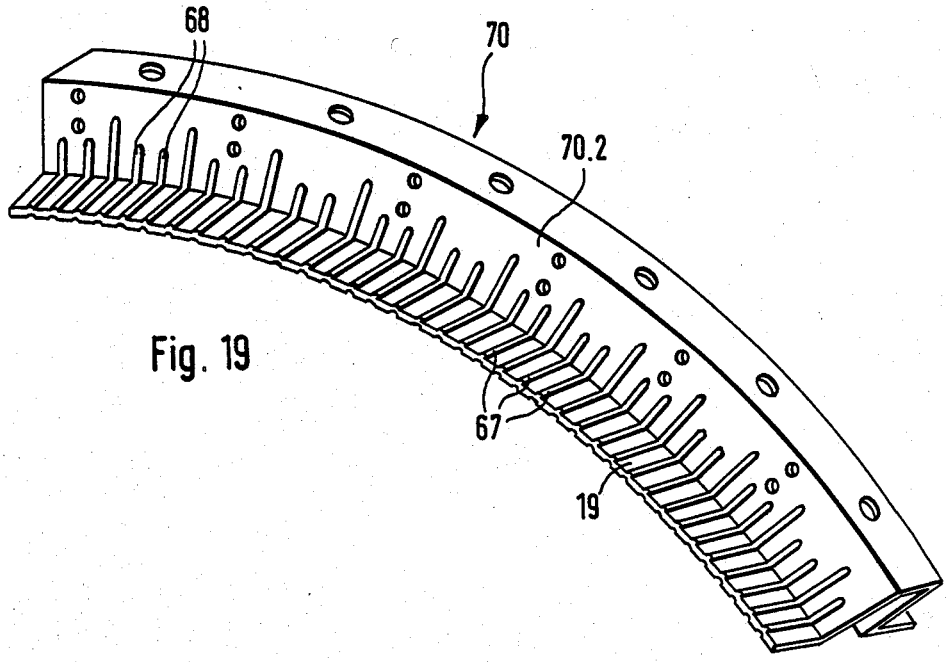
FIG. 19 is a view showing a bent portion of the supporting rail in accordance with the present invention, provided with a plurality of corrugations.

FIG. 18 shows a portion of a supporting rail 15 whose bending cuts 66 are arrow-shaped in the base 15.1 and therefore extend inclinedly relative to the longitudinal direction of the supporting rail. Supporting rail 15 can be worked preferably in a bending device provided with bending rollers, as well as a supporting rail 70 which is shown in FIG. 19. The supporting rail 70 does not have bending cuts. Instead, it is provided with a plurality of corrugations 67 in the rail edges 19 and a plurality of corrugations 68 in legs 70.2 of the rail. The individual crimps of the corrugations 68 extend from the rail edges 19 with a different length into the legs 70.2. The corrugations 67, 68 allow a compression of the supporting rail 70 and thereby an exact and continuous bending of the supporting rail 70.

It will be understood that each of the elements described above, or two or more together, may also find a useful application in other types of constructions differing from the types described above.

While the invention has been illustrated and described as embodied in a supporting rail for lower ceilings and attachments, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A supporting rail for objects, particularly, lower ceilings, attachments and the like, comprising an elongated central rail part; and at least one elongated side rail edge extending along said central rail part and located at its one end for suspending shaped panels, boards and the like, said central rail part being provided with a plurality of formations spaced from one another in a longitudinal direction and allowing bending said central rail part, said central rail part being also provided with a plurality of through-going openings located between said formations for inserting additional elements, said formations in said central rail part being formed as a plurality of corrugations formed for allowing a compression of said central rail part in a longitudinal direction.

2. A supporting rail as defined in claim 1, wherein said through-going openings in said central rail part extend parallel to said formations.

3. A supporting rail as defined in claim 1, wherein said through-going openings in said central rail part are formed so that additional coupling elements can be fixed in said through-going openings.

4. A supporting rail as defined in claim 1, wherein said through-going openings in said central rail part are formed so that additional safety elements can be fixed in said through-going openings.

5. A supporting rail as defined in claim 1, wherein said through-going openings in said central rail part are formed so that additional suspending elements can be fixed in said through-going openings.

6. A supporting rail as defined in claim 1, wherein said corrugations extend outwardly over said at least one side rail edge.

7. A supporting rail as defined in claim 1, wherein said corrugations on said central rail part include corrugations of different lengths.

8. A supporting rail as defined in claim 1, wherein said central rail part as U-shaped and has a base and two legs, said corrugations extending through said legs.

9. A supporting rail for objects, particularly, lower ceilings, attachments and the like, comprising an elongated central rail part; and at least one elongated side rail edge extending along said central rail part and located at its one end for suspending shaped panels, boards and the like, said central rail part being provided with a plurality of formations spaced from one another in a longitudinal direction and allowing bending said central rail part, said central rail part being also provided with a plurality of through-going openings located between said formations for inserting additional elements, said central rail part including two walls which abut against one another and together form a web having a free web edge and an opposite web edge associated with said side rail edge, said formations being formed as corrugations extending over said side rail edge and said opposite web edge.

10. A supporting rail for objects, particularly, lower ceilings, attachments and the like, comprising an elongated central rail part, said central rail part being provided with a plurality of formations spaced from one another in a longitudinal direction and allowing bending said central rail part, said central rail part being also provided with a plurality of through-going openings located between said formations for inserting additional elements, said central rail part being subdivided into a plurality of portions each having two ends; at least one elongated side rail edge extending along said central rail part and located at its one end for suspending shaped panels, boards and the like; and a U-shaped coupling member arranged to couple the ends of two neighboring ones of said portions, said coupling member being provided with wall openings which are bringable into alignment with said through-going openings for allowing insertion of said additional elements therethrough.

11. A supporting rail as defined in claim 10, wherein said U-shaped coupling member is formed so that it can be fitted onto said ends of said central rail part of said two neighboring ones of said portions.

12. A supporting rail as defined in claim 10, wherein said U-shaped coupling member is formed so that it can be inserted into said ends of said central rail part of said two neighboring ones of said portions.

13. A supporting rail as defined in claim 10, wherein said coupling member is provided with at least one bending cut to allow its bending.

14. A suspending element for a supporting rail which has an elongated central rail part; and at least one elongated side rail edge extending along said central rail part and located at its one end for suspending shaped panels, boards and the like, the central rail part being provided with a plurality of formations spaced from one another in a longitudinal direction and allowing bending the central rail part, the central rail part being also provided with a plurality of through-going openings located between the formations for inserting additional elements, the supporting element comprising a coupling member arranged to abut against said central rail part and provided with a plurality of openings distributed over a circular arc.

15. A securing element for a supporting rail which has an elongated central rail part; and at least one elongated side rail edge extending along the central part and located at its one end for suspending shaped panels, boards and the like, said central rail part being provided with a plurality of formations spaced from one another in a longitudinal direction and allowing bending said central rail part, the central rail part being also provided with a plurality of through-going openings located between the formations for inserting additional elements, the formations being formed as cuts allowing spreading of said central rail part, the securing element comprising a securing member insertable into said central rail part and securing the same after spreading of said central rail.

16. A securing element as defined in claim 15, wherein said securing member is formed as an insertion member insertable into said cuts upon spreading of said central rail part.

17. A securing element as defined in claim 15, wherein said securing member is formed as a U-shaped clamp with legs insertable into said through-openings of said central rail part.

18. A supporting rail as defined in claim 15, wherein said cuts are formed in said side rail part spaced from one another by uniform distances, have uniform dimensions, and arranged at a distance of one of said side rail edges.

19. A supporting rail as defined in claim 18, wherein said cuts in said central rail part are formed so that a spreading tool can be inserted thereinto for spreading and therefore bending said central rail part.

20. A supporting rail as defined in claim 18, wherein said central rail part has a plurality of additional wall openings arranged so that one of said wall openings is provided at each side of a respective one of said cuts.

21. A supporting rail as defined in claim 15, wherein said rail portions each have two ends and each provided with a plug projection at one of said ends and a complementary plug opening at the other of said ends so that said plug projection of one of said portions can be inserted into said plug opening of the other of said portions and at least some of said through-going openings of said one and other portions are brought in alignment with one another for receiving said additional elements.

22. A supporting rail as defined in claim 21, wherein each of said portions is provided with at least one of said cuts in said central rail part.

23. A supporting rail as defined in claim 21, wherein each of said plug projections is formed as a bent part extending straight from a respective one of said portions in the longitudinal direction.

24. A supporting rail as defined in claim 15, wherein said central rail part has a U-shaped cross section with a base and two legs, said formations being formed as cuts extending through said base and said legs.

25. A supporting rail as defined in claim 15, wherein said central rail part includes two walls which abut against one another and together form a web with a free web edge, said cuts extending from said free web edge.

26. A supporting rail as defined in claim 15, wherein said central rail has two end regions and a central region between them, said cuts being provided in said end regions and in said central region and formed so that said cuts in said central region have a greater width than said cuts in said end regions.

* * * * *